US005772269A

United States Patent [19]

Henning, Jr. et al.

[11] Patent Number: 5,772,269

[45] Date of Patent: Jun. 30, 1998

[54] HOISTING TOOL

[75] Inventors: Arnold W. Henning, Jr., Claremont; Marion R. Watkins, Collinsville; Walter M. Wright, Skiatook; James A. Battle, Broken Arrow, all of Okla.

[73] Assignee: McConnell Douglas Corporation, Long Beach, Calif.

[21] Appl. No.: 728,028

[22] Filed: Oct. 9, 1996

Related U.S. Application Data

[60] Provisional application No. 60/027,285 Sep. 30, 1996.

[51] Int. Cl.[6] ..... B66C 1/10

[52] U.S. Cl. ..... 294/67.22; 294/67.5

[58] Field of Search ..... 294/67.1–67.22, 294/67.4, 67.41, 67.5, 81.1, 81.2, 81.3, 81.4, 81.5, 81.51, 81.55, 81.6, 74, 119.2

[56] References Cited

U.S. PATENT DOCUMENTS

| | | | |
|---|---|---|---|
| 1,591,248 | 7/1926 | Tracy . | |
| 2,338,998 | 1/1944 | Cassens et al. | 294/82 |
| 2,514,307 | 7/1950 | Boyd | 294/82 |
| 2,761,725 | 9/1956 | Rushing | 294/81.5 |
| 2,986,422 | 5/1961 | Renfroe | 294/101 |
| 3,275,367 | 9/1966 | Bopp | 294/81.3 |
| 3,655,068 | 4/1972 | Ervin | 294/67.5 |
| 3,861,546 | 1/1975 | Montgomery | 294/67.4 |
| 3,913,965 | 10/1975 | Muller et al. | 294/67.1 |
| 3,970,342 | 7/1976 | Cottom | 294/74 |
| 4,030,747 | 6/1977 | Morse et al. | 294/92 |
| 4,737,069 | 4/1988 | Coblentz | 294/74 |
| 4,799,296 | 1/1989 | Rasmussen | 294/74 |
| 4,818,004 | 4/1989 | Oswalt et al. | 294/81.3 |
| 5,071,183 | 12/1991 | McDermont et al. | 294/67.2 |

FOREIGN PATENT DOCUMENTS

| | | | |
|---|---|---|---|
| 668211 | 11/1938 | Germany | 294/67.21 |

*Primary Examiner*—Dean Kramer
*Attorney, Agent, or Firm*—Bell Seltzer Intellectual Property Law Group of Alston & Bird LLP

[57] ABSTRACT

A flap handling tool which eliminates rigid hookup at fixed points and permits ease of location of lift points, disburses the lifting load over a broad area and permits an evaluation of proper position of loading strap anchor points during lift and excessive stresses. A flap handling tool is provided which includes a flap engaging fixture for receiving the trailing edge of a flap and a flexible strap assembly designed to be twice the proof load or twice the working load. The flap handling tool may be used in multi-lift point applications. Two such tools distributes the lifting factor in four places doing away with the normal three point solid lift. The hoisting structure, i.e. overhead crane and cables are attached to a lug on the engaging fixture and a D-ring sewn into the strap. As an overhead crane is directed up, the operator can visually observe any stretch on nylon strap permitting early detection of excessive weight, misalignment or mispositioning conditions thereby providing a greater margin for finding and correcting error. Tension adjustment is included on the engaging fixture to eliminate slippage and insure a tight connection. Those portions of the flap engaging fixture which actually are in contact with the flap surface have a resilient padding to avoid damage to the control surface.

21 Claims, 4 Drawing Sheets

HOISTING TOOL

CROSS-REFERENCE TO RELATED APPLICATION

This application claims the benefit of U.S. Provisional patent application Ser. No. 60/027,285, entitled "Hoisting Tool" and filed on Sep. 30, 1996.

BACKGROUND OF INVENTION

1. Field of the Invention

The Field of this invention relates to the hoisting and movement of air foils and air foil sections during maintenance and fabrication. More specifically, this invention relates to tools and fixtures used to move flaps.

2. Related Art

The original related art tools consisted of multiple steel pads and could not account for adverse loads while it is suspended. This often resulted in both breaking or pulling or deformation of the internal structure through the outer skin of the aircraft. This results in extensive damage to the flaps and delayed flight schedules. In addition, the possibility of sections of the aircraft falling on crew members or equipment is increased. Other tools such as that described in U.S. Pat. No. 4,030,747 to MORRIS provides a gripper for use in hoisting sheet structure which binds with the structure thereby increasing the likelihood of damage. The prior tooling shown in U.S. Pat. No. 2,514,307 to BOYD maintains the load in a predetermined position and has little, if any, flexibility. U.S. Pat. No. 2,338,998 to CASSENS discloses solid bar having multiple hooks for lifting of hollow articles. This particular mechanism has solid lifting bars with the hooks engaging hollow areas of the article to be lifted and will not work on moving flap or other airfoil structures. A tool is required which identifies adverse loads while suspended and can correct the position of such adverse loads while suspended. The apparatus must be flexible enough to install aircraft flight controls from staging areas and be capable of harnessing very fragile flight control surfaces while at the same time adjusting the particular attitude without any compromise to surface loading. In addition, it is desirable to have a tool which will permit the removal of flight control surfaces from cargo handling fixtures while orientating the same for direct installation on aircraft.

BRIEF DESCRIPTION OF INVENTION

The flap handling tool of the instant invention can be adapted to any aircraft or various parts of any aircraft in addition to flaps and eliminates rigid hookup at fixed points and permits ease of location of lift points, disburses the lifting load over a broad area and permits an evaluation of loading straps. A flap handling tool is provided which includes a flap engaging fixture and a flexible strap assembly designed to be twice the proof load or twice the working load. The strap is nylon and provided with a metal hooks or loops at either end for engaging lugs on the flap handling fixture. The nylon strap is combined with an aluminum engaging fixture for receiving the trailing edge of the flap with resilient pads to protect the surface of the flap. This flap handling tool distributes the lifting factor in four places doing away with the normal three point solid lift normally bolted directly to the control surface at three lifting points. The hoisting structure, i.e. overhead crane and cables are attached to a lug on the engaging fixture and a D-ring sewn into the strap. As an overhead crane is directed up, the operator can visually observe any stretch on nylon strap permitting early detection of excessive weight, misalignment or mispositioning conditions thereby providing a greater margin for finding and correcting error. The typical strap is 2" in width and capable of withstanding 2,000 pounds of pressure. The hook on the strap engages a lug on the flap engaging fixture. The nylon strap has a ratchet connected intermediate of the nylon strap to provide tension sufficient to secure the fixture and the strap about the air foil and provides a gross tension adjustment. The flap engaging fixture also includes an adjustable tension bar which may be tightened to eliminate slippage and insures a very tight connection. The flap engaging fixture is a generally clam shell shaped bracket which positions the strap away from the lower portion of the flap to permit operation of the ratchet without contacting the surface of the flap. Those portions of the flap engaging fixture which actually are in contact with the flap surface have rubber or other resilient padding to avoid damage to the surface.

In operation, at least two flap handling tools are used. One is positioned inboard of the control surface, i.e. flap, and the other is positioned outboard of the control surface.

A cable of the lifting apparatus is connected to the lifting lug on the flap engaging fixture and another to the D-ring of the strap. Lifting is accomplished by operation of air motors on the cable hoist.

There are alternative versions of the flap engaging fixture for different size loads. One version uses multiple straps, while the other uses a single strap.

DESCRIPTION OF THE PREFERRED EMBODIMENT

Figure 1:
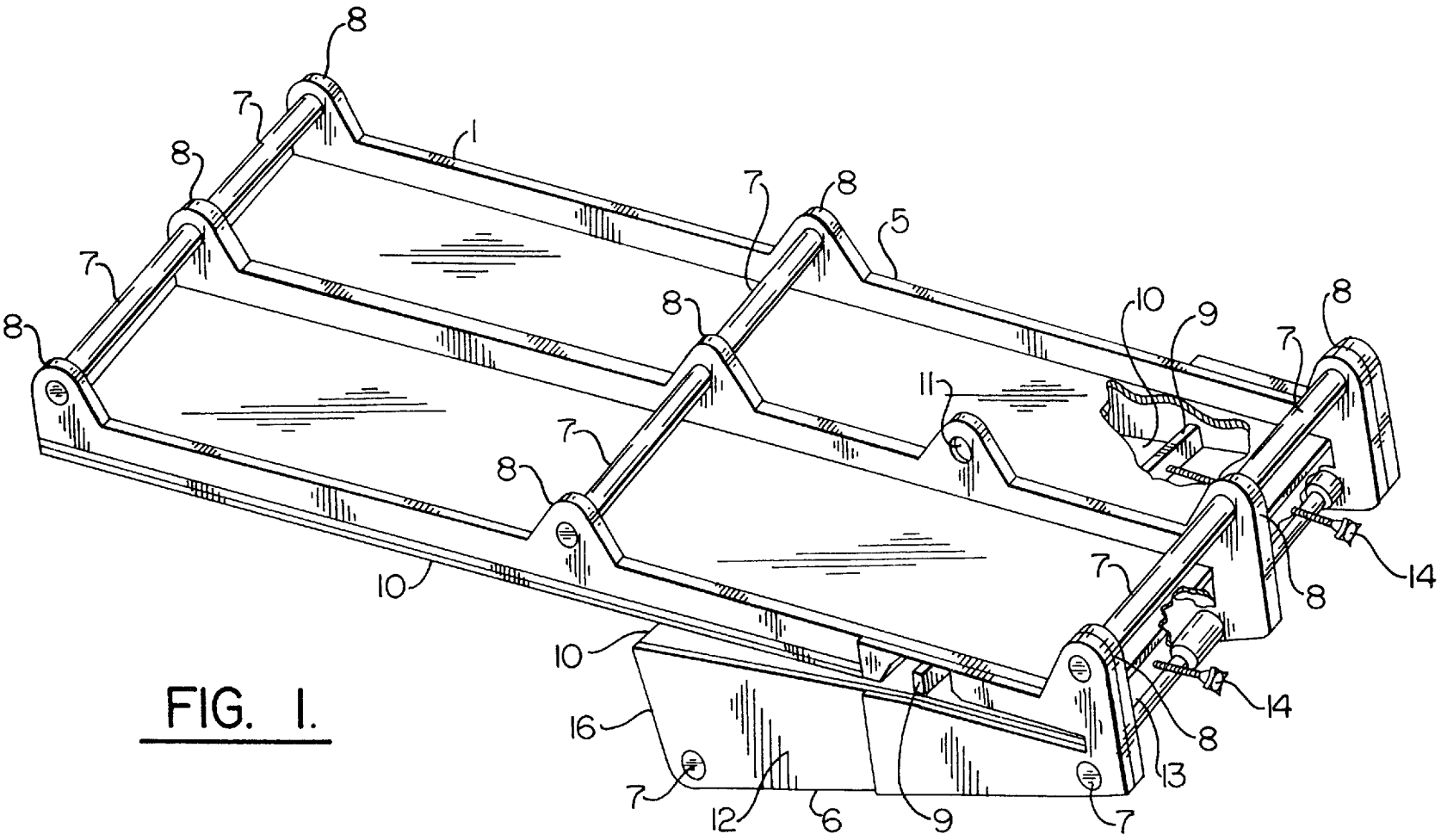
FIG. 1 is a perspective view of a multi-strap flap handling fixture.

FIG. 1 shows a flap engaging fixture 1 which engages the trailing edge of the flap 4. The flap engaging fixture is a clam shell type bracket having an elongated upper section 5 and a shorter lower section 6. The upper section 5 has a plurality of engagement lugs 8 each of which receives a lug shaft 7 to which the hooks of strap 2 may be attached. Alternatively at least one end of the strap 2 may be fashioned into a loop which is permanently attached to a lug shaft 7. The lower section 6 has a curved upper surface which is shaped to fit the curvature of the trailing edge of the flap 4. The upper and lower sections are spaced apart by an intermediate section 13. The sides 12 of the lower section are generally triangular with the apex of the triangle disposed toward the intermediate section 13. The opposite end 16 of the lower section 6 (the base of the triangle) has a lug shaft 7 which is spaced apart from the upper section 5 sufficient to position the ratchet 15 away from the surface of the flap 4 to permit operation thereof without impacting the surface of the flap 4 when the strap is engaged. Those portions of the flap engaging fixture which are in direct contact with the surface of flap 4 have rubber padding or other resilient material 10 to prevent damage to the surface of the flap 4 during installation or lifting.

The flap engaging fixture 1 includes an adjustable tension bar 9 which is disposed in the space between said upper section 5 and said lower section 6 and is adjusted by manipulation of set or adjustment screws 14 which move a tension bar 9 against the trailing edge of the flap 4 to insure a tight connection.

The upper section 5 is also provided with a lifting lug or bracket 11 to provide a first anchor point for lifting cables utilized by the lifting apparatus. The first anchor point is positioned at one end of the upper section 5 and generally over the center of the lower section 6.

Figure 2A:
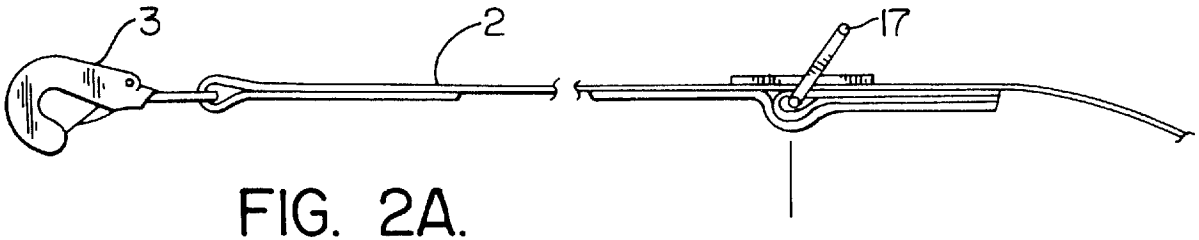
FIG. 2 is a side view of the strap assembly including the D-ring and ratchet.
Figure 2B:
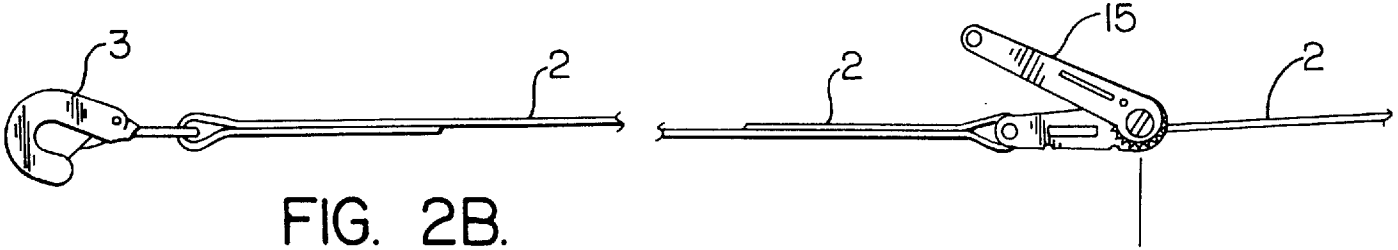

The flap handling tool includes a flexible strap assembly 2 adapted to be connected to the flap engaging fixture 1 and is designed to be twice the proof load or twice the working load of the lifting apparatus. As shown in FIG. 2 the strap assembly 2 is provided with a metal hook 3 on both ends (however, one end may be a loop of strap material). The strap 2 is nylon and is combined with the flap engaging fixture 1. As can be seen in FIG. 2 the strap assembly 2 includes a ratchet 15 intermediate of said strap 2 and in this particular view a hook 3 attached at each end of said nylon strap 2. Alternatively a loop may be at one end for permanent engagement with a lug shaft 7 of the engagement fixture 1. The typical strap is 2" in width and capable of lifting 2,000 pounds. The hook 3 on the strap 2 engages any of several lug shafts 7 located at several points on the engaging fixture 1. As shown in FIG. 1 multiple lug shafts 7 permit multiple straps to be used. The ratchet 15 which connects to the strap permits the coarse ratchet adjustment of the tension of the strap 2 while the adjustment screws 14 permit fine adjustment of the tension bar 9 as described above.

Figure 3:
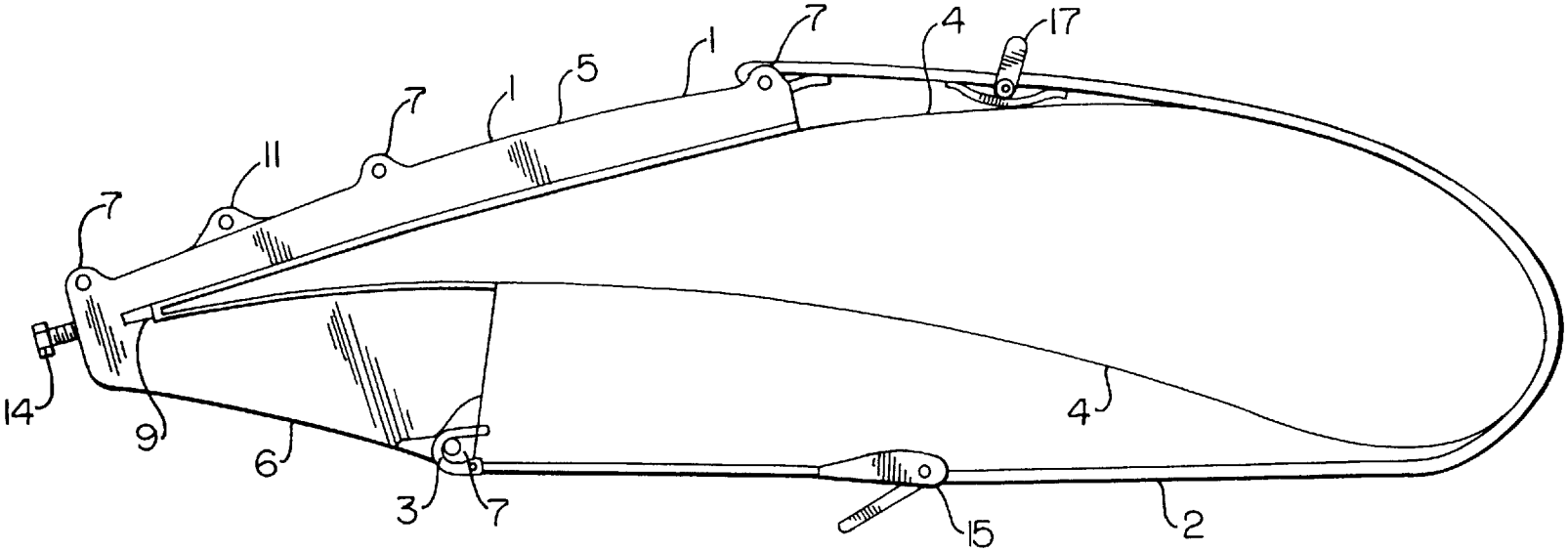
FIG. 3 is a side view of the multi-strap flap handling tool engaging a flap.

The strap 2 is also provided with a D-ring 17 which is attached to the upper section of the strap 2. That is when the strap 2 is attached to the flap engagement fixture 1 and is looped about the flap 4 as shown in FIG. 3, the D-Ring 17 is disposed on top of the flap 4 and spaced apart from the lug 11 such that a second anchor point is provided near the leading edge of the flap 4.

Multiple flap handling tools 1 with a strap 2 assembly are used to lift structural components such as an airfoil flap 4. Each flap handling tool, that is the flap engaging fixture 1 and the strap assembly 2, engages the flap 4 and distributes the lifting factor about the surface of the flap. When utilizing inboard and outboard flap handling tools, this results in 4 lift (anchor) points avoiding the normal 3 point solid lift. When the operator directs the lifting crane upwards, he can observe any stretch on nylon strap 2 permitting a greater margin for finding and correcting errors in position, weight or misalignment.

Multiple flap holding fixtures and strap assemblies may be used at various lifting points along the component to be lifted.

In use the flap engaging fixture 1 is first attached to the trailing edge of the flap as shown in FIG. 2. The longer upper section 5 is placed on top of the flap 4 and the space between the upper and lower sections receives the trailing edge of the flap 4. The lower section 6 of the engaging fixture receives the hook 3 on the strap at a lug shaft 7. The looped end of the strap is attached to the upper section of the engaging fixture at another lug shaft 7. Although a loop and hook structure are described which retains the strap assembly in connection with the engaging fixture 1, both ends of said strap can be hooked and manually attached to each lug shaft 7.

Once the strap is hooked to the flap engaging fixture 1 the ratchet 15 may be used to take up slack in the strap 2 as a coarse adjustment. The adjustment screws 14 are then manipulated to provide fine adjustment by moving the tension bar 9 against the trailing edge of the flap 4.

A first flap handling tool is attached to the inboard section of the flap as described above and a second attached to the outboard section of the flap. The cables of the lifting apparatus are attached to the lug 11 and the D-ring 17 and the lifting apparatus raised and the flap 4 is moved to the position desired.

Since there are four separate anchor points the motors on the lifting device may be actuated to have specific cables and orient the flap in any given position or orientation.

Figure 4:
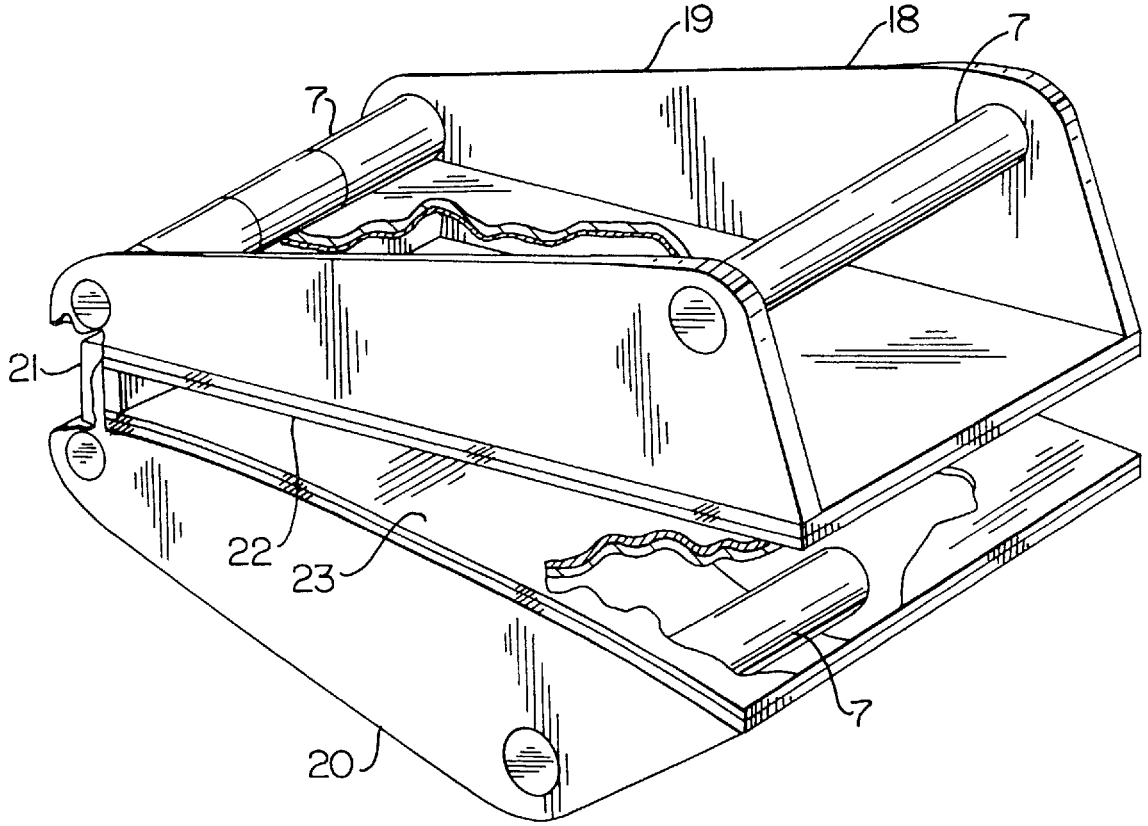
FIG. 4 is perspective view of a single strap flap handling fixture.

FIG. 4 shows an alternative flap engaging fixture 18 which is similar in design to the first embodiment but does not include adjustment screws and is intended to use only a single strap assembly 2.

The alternative embodiment includes an upper section 19, an intermediate section 21, and a lower section 20. The intermediate section is integral with the upper and lower sections and spaces them apart a distance sufficient to receive the trailing edge of a flap 4 or other control surface. Those portions of the flap engaging fixture 18 which are in contact with the surface of the flap 4 are provided with a rubber or other resilient material 10 as before.

The contact surfaces 22 and 23 are each shaped to match the outer shape of the trailing edge of the flap 4. While the alternative embodiment is slightly different in shape it operates in the identical manner as before and utilizes the same strap assembly 2. However, no lug 11 is present and the first anchor point must then be-provided by either a second D-ring 17 or attachment of the lifting apparatus to one of the upper section lug shafts 7. Each of the D-rings 17 are attached to the strap by a looped section of strap. The specific area of the strap 2 above the D-Ring 17 may be reinforced with a strip of leather or strap material stitched into place.

Having thus described the invention what is claimed is:

1. A lifting apparatus for lifting structural components comprising:

a bracket having an upper section and a lower section joined together in spaced-apart relation to define a slot therebetween adapted to receive a portion of the component to be lifted, a flexible strap releasably engaging at least one of said sections and adapted to at least partially encircle the component to be lifted, and an adjustment mechanism disposed within said slot and adapted to engage the component to bias the component in a direction to cause tightening of said flexible strap around the component.

2. A lifting apparatus as described in claim 1 wherein said upper section and lower section are joined via an intermediate section which spaces said upper and lower sections apart to form said slot.

3. A lifting apparatus for lifting a component comprising:

a bracket including an upper section and a lower section, and an intermediate section which spaces said upper and lower sections apart to define a slot adapted to receive a portion of the component;

a flexible strap releasably engaging at least one of said sections and adapted to encircle the component;

an adjustment apparatus for tightening said flexible strap about said component; and an adjustment bar disposed between said upper and lower sections in juxtaposition with said intermediate section adapted for motion along a longitudinal axis of said slot.

4. A lifting apparatus as described in claim 3 wherein said intermediate section receives at least one adjusting mechanism which engages said adjustment bar and is adapted for moving said adjustment bar.

5. A lifting apparatus as described in claim 4 wherein said adjusting mechanism includes at least one adjustment screw received by screw threads in said intermediate section which screw has an adjustment end adapted for rotational manipulation and the other end of which is adapted for rotational engagement with said adjustment bar.

6. A lifting apparatus as described in claim 5 further comprising a ratchet which engages said flexible strap and permits adjustment of the effective length of said strap.

7. A lifting apparatus as described in claim 6 wherein said upper section and lower section of said bracket include a layer of flexible material on the inner side of said slot for engaging said component.

8. A lifting apparatus for lifting structural components comprising:

a bracket having a rigid upper section and a rigid lower section joined together in spaced-apart relation to define a slot therebetween adapted to receive a portion of the component to be lifted, a flexible strap releasably engaging at least one of said sections and adapted to at least partially encircle the component to be lifted, and an adjustment mechanism disposed within said slot and adapted to bias the component in a direction to cause tightening of said flexible strap around the component.

9. A lifting apparatus as described in claim 8 wherein said upper section and lower section are joined via an intermediate section which spaces said upper and lower sections apart to form said slot.

10. A lifting apparatus as described in claim 9 wherein said adjustment mechanism comprises an adjustment bar disposed between said upper and lower sections in juxtaposition with said intermediate section adapted for motion along the longitudinal axis of said slot.

11. A lifting apparatus as described in claim 10 wherein said intermediate section receives at least one adjusting mechanism which engages said adjustment bar and is adapted for moving said adjustment bar.

12. A lifting apparatus as described in claim 11 wherein said adjusting mechanism includes at least one adjustment screw received by screw threads in said intermediate section which screw has an adjustment end adapted for rotational manipulation and the other end of which is adapted for rotational engagement with said adjustment bar.

13. A lifting apparatus as described in claim 12 further comprising a ratchet which engages said flexible strap and permits adjustment of the effective length of said strap.

14. A lifting apparatus as described in claim 13 wherein said upper section and lower section of said bracket include a layer of flexible material on the inner side of said slot for engaging said component.

15. A lifting apparatus for lifting structural components comprising:

a bracket having an upper section and a lower section joined together in spaced-apart relation to define a slot therebetween adapted to receive a portion of the component to be lifted, said upper section including lift points for applying lift, a flexible strap releasably engaging at least one of said sections and adapted to encircle the component to be lifted, and an adjustment mechanism disposed within said slot and adapted to bias the component in a direction to cause tightening of said flexible strap around the component.

16. A lifting apparatus as described in claim 15 wherein said upper section and lower section are joined via an intermediate section which spaces said upper and lower sections apart to form said slot.

17. A lifting apparatus as described in claim 16 wherein said adjustment mechanism comprises an adjustment bar disposed between said upper and lower sections in juxtaposition with said intermediate section adapted for motion along the longitudinal axis of said slot.

18. A lifting apparatus as described in claim 17 wherein said intermediate section receives at least one adjusting mechanism which engages said adjustment bar and is adapted for moving said adjustment bar.

19. A lifting apparatus as described in claim 18 wherein said adjusting mechanism includes at least one adjustment screw received by screw threads in said intermediate section which screw has an adjustment end adapted for rotational manipulation and the other end of which is adapted for rotational engagement with said adjustment bar.

20. A lifting apparatus as described in claim 19 further comprising a ratchet which engages said flexible strap and permits adjustment of the effective length of said strap.

21. A lifting apparatus as described in claim 20 wherein said upper section and lower section of said bracket include a layer of flexible material on the inner side of said slot for engaging said component.

* * * * *